US010138724B2

(12) United States Patent
Querales et al.

(10) Patent No.: US 10,138,724 B2
(45) Date of Patent: Nov. 27, 2018

(54) MONITORING, DIAGNOSING AND OPTIMIZING GAS LIFT OPERATIONS BY PRESENTING ONE OR MORE ACTIONS RECOMMENDED TO ACHIEVE A GL SYSTEM PERFORMANCE

(71) Applicant: Landmark Graphics Corporation, Houston, TX (US)

(72) Inventors: Maiquel Manuel Querales, Katy, TX (US); Miguel Villamizar, Houston, TX (US); Gustavo Carvajal, Katy, TX (US); Rama Krishna Vellanki, Houston, TX (US); Giuseppe Moricca, Codogno (IT); Alvin Stanley Cullick, Thornton, CO (US); Jose Rodriguez, Katy, TX (US)

(73) Assignee: Landmark Graphics Corporation, Houston, TX (US)

( * ) Notice: Subject to any disclaimer, the term of this patent is extended or adjusted under 35 U.S.C. 154(b) by 624 days.

(21) Appl. No.: 13/711,815

(22) Filed: Dec. 12, 2012

(65) Prior Publication Data

US 2014/0039793 A1 Feb. 6, 2014

Related U.S. Application Data

(60) Provisional application No. 61/678,069, filed on Jul. 31, 2012.

(51) Int. Cl.
*E21B 47/00* (2012.01)
*E21B 43/12* (2006.01)

(52) U.S. Cl.
CPC ..... *E21B 47/00* (2013.01); *E21B 43/122* (2013.01)

(58) Field of Classification Search
CPC ..... E21B 47/00
(Continued)

(56) References Cited

U.S. PATENT DOCUMENTS 5,748,500 A 5/1998 Quentin et al.
5,829,520 A * 11/1998 Johnson ..... E21B 43/086 166/250.01

(Continued)

FOREIGN PATENT DOCUMENTS

WO 2009/107000 9/2009
WO 2011/163521 12/2011

(Continued)

OTHER PUBLICATIONS

"Gas Lift Diagnostics & Optimization", Schlumberger. Jan. 25, 2013 http://www.slb.com/services/software/production_software/intprodsurv/avocetglm.aspx, (2013),2 pgs.

(Continued)

*Primary Examiner* — Alexander Satanovsky
*Assistant Examiner* — Lina M Cordero
(74) *Attorney, Agent, or Firm* — Alan Bryson; Parker Justiss, P.C.

(57) ABSTRACT

Systems and methods for monitoring, diagnosing and optimizing operation of a gas lift (GL) system, at least some of which include a method that includes collecting measured data representative of the GL system's state, storing the measured data, comparing the measured data to a well model's calculated data for the well and identifying likely conditions of the GL system based on mismatches between the measured data and the calculated data. The method further includes updating the model to reflect the likely conditions and selected corrections of the likely conditions, generating GL system performance curves using the updated model and presenting to a user actions recommended to (Continued)

achieve a GL system performance consistent with a GL system operating point on at least one of the GL system performance curves.

17 Claims, 6 Drawing Sheets

(58) Field of Classification Search
USPC ..... 702/6
See application file for complete search history.

(56) References Cited

U.S. PATENT DOCUMENTS

| | | | | |
|---|---|---|---|---|
| 6,229,308 | B1 | 5/2001 | Freedman | |
| 6,236,894 | B1 | 5/2001 | Stoisits et al. | |
| 7,172,020 | B2 * | 2/2007 | Tseytlin | E21B 43/12 166/250.07 |
| 9,261,097 | B2 | 2/2016 | Moricca et al. | |
| 2002/0049575 | A1 * | 4/2002 | Jalali | E21B 43/00 703/10 |
| 2004/0244989 | A1 * | 12/2004 | Eken | E21B 43/12 166/369 |
| 2007/0252717 | A1 | 11/2007 | Fielder | |
| 2007/0272442 | A1 * | 11/2007 | Pastusek et al. | 175/40 |
| 2008/0065362 | A1 * | 3/2008 | Lee | E21B 41/00 703/10 |
| 2008/0270328 | A1 | 10/2008 | Lafferty et al. | |
| 2010/0042458 | A1 * | 2/2010 | Rashid | G06Q 10/04 703/10 |
| 2010/0082275 | A1 | 4/2010 | Borsting et al. | |
| 2010/0082388 | A1 * | 4/2010 | Dixit et al. | 705/7 |
| 2010/0211423 | A1 | 8/2010 | Hehmeyer | |
| 2011/0022433 | A1 * | 1/2011 | Nielsen et al. | 705/7 |
| 2011/0088484 | A1 | 4/2011 | Camilleri | |
| 2011/0186353 | A1 * | 8/2011 | Turner et al. | 175/40 |
| 2012/0095603 | A1 * | 4/2012 | Rashid et al. | 700/282 |
| 2012/0118637 | A1 * | 5/2012 | Wang | E21B 44/00 175/24 |
| 2014/0039836 | A1 | 2/2014 | Moricca et al. | |

FOREIGN PATENT DOCUMENTS

| | | |
|---|---|---|
| WO | 2014/022318 | 2/2014 |
| WO | 2014/022320 | 2/2014 |

OTHER PUBLICATIONS

"The Role and development of the Operational Asset Optimization Model Within DecisionSpace for Production Solutions", Landmark. 2007. http://www.halliburton.com/public/landmark/contents/papers_and_articles/web/h05631.pdf, (2007), 15 pgs.

Al-Jasmi, Ahmad et al., Abstract, "Gas-Lift Smartflow that Integrates Quality and Control Data for Diagnostics and Optimization in Real Time.", 2013 SPE Digital Energy. Mar. 5, 2013. The Woodlands, TX., (Jul. 24, 2012), 1 pg.

PCT International Preliminary Report on Patentability, dated Oct. 21, 2014, Appl No. PCT/US2013/52595, "Monitoring, Diagnosing and Optimizing Gas Lift Operations," filed Jul. 29, 2013, 31 pgs.

PCT International Preliminary Report on Patentability, dated Sep. 18, 2014, Appl No. PCT/2013/052591, "Electric Submersible Pump Operations," Filed Jul. 29, 2013, 14 pgs.

PCT International Search Report and Written Opinion, dated Dec. 16, 2013, Appl No. PCT/US/13/52591, "Monitoring, diagnosing and optimizing electric submersible pump operations," filed Jul. 29, 2013, 17 pgs.

PCT International Search Report and Written Opinion, dated Feb. 7, 2014, Appl No. PCT/US2013/52595, "Monitoring, Diagnosing and Optimizing Gas Lift Operations," filed Jul. 29, 2013, 19 pgs.

U.S. Non Final Office Action, dated Apr. 23, 2015, U.S. Appl. No. 13/609,163, "Monitoring, Diagnosing and Optimizing Electric Submergible Pump Operations," filed Sep. 10, 2012, 23 pgs.

SG Office Action, dated Oct. 9, 2015 "Monitoring, Diagnosing and Optimizing Gas Lift Operations," Appl No. 11201500442X, filed 07/29/20113, 22 pgs.

SG Office Action, dated Sep. 22, 2015 Monitoring, Diagnosing and Optimizing Electric Submersible Pump Operations, Appl No. 11201500391P, filed Jul. 29, 2013, 13 pgs.

EP Extended Search Report, dated Feb. 9, 2016 Monitoring, Diagnosing and Optimizing Electric Submersible Pump Operations, Appl No. 13824877.8, filed Jul. 29, 2013, 4 pgs.

CA Examination Report, dated Jan. 18, 2016 "Monitoring, Diagnosing and Optimizing Gas Lift Operations", Appin. No. 2,880,128, Filed Jul. 29, 2013, 5 pgs.

* cited by examiner

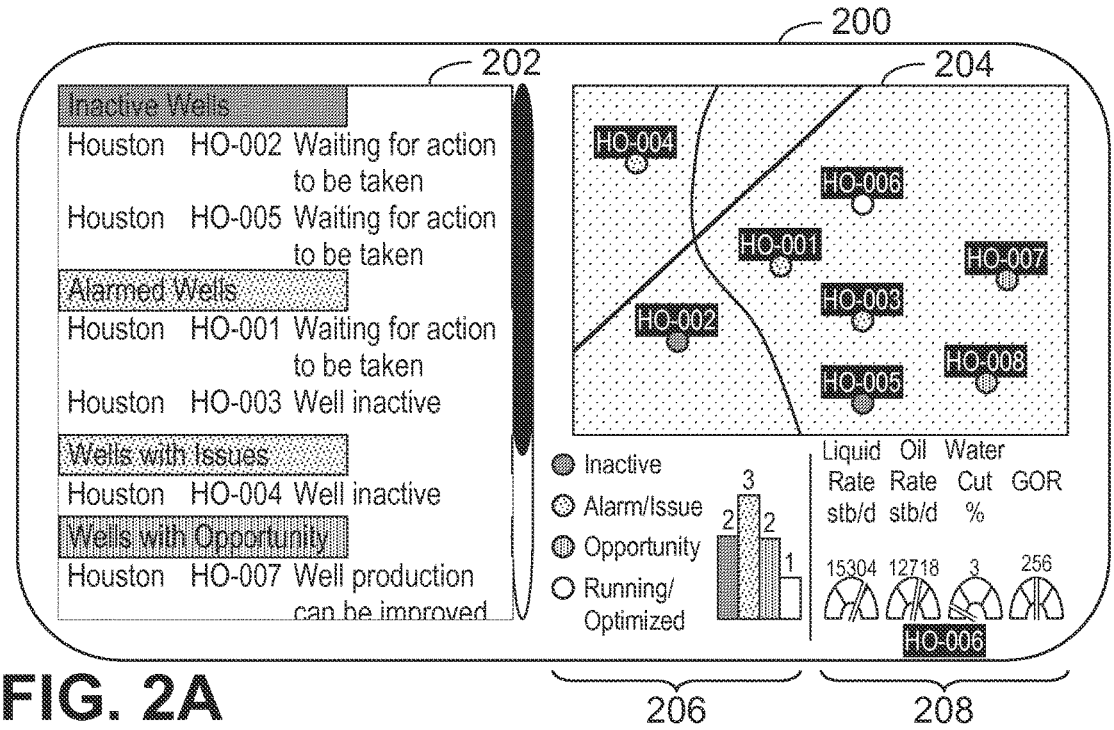
FIG. 2A
FIG. 2B
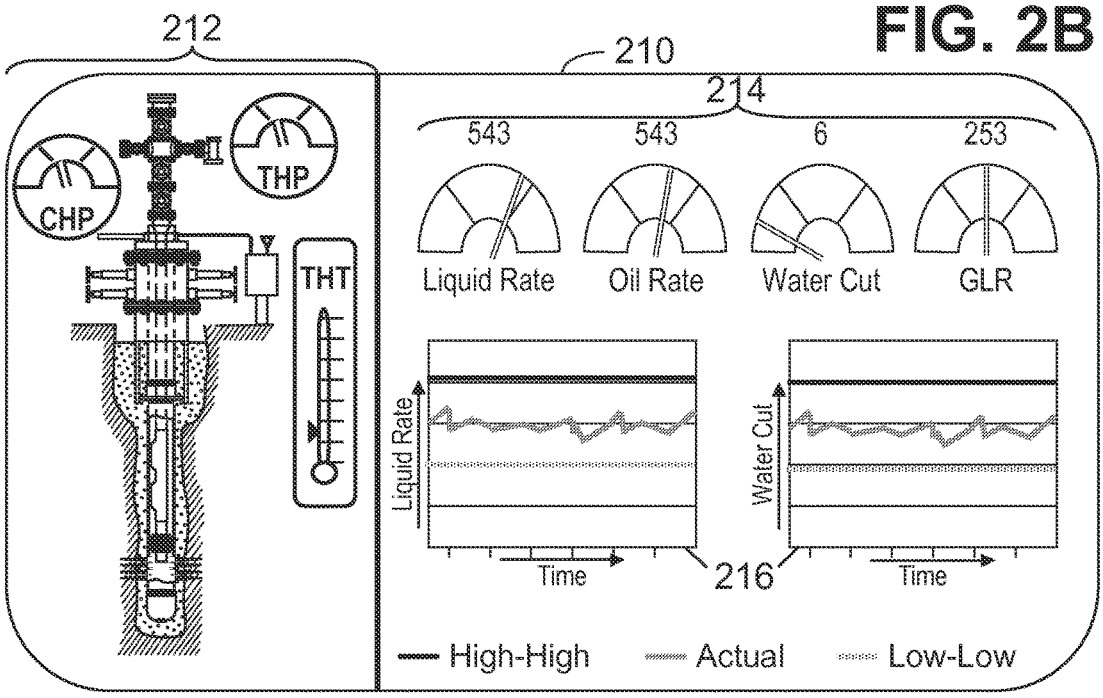

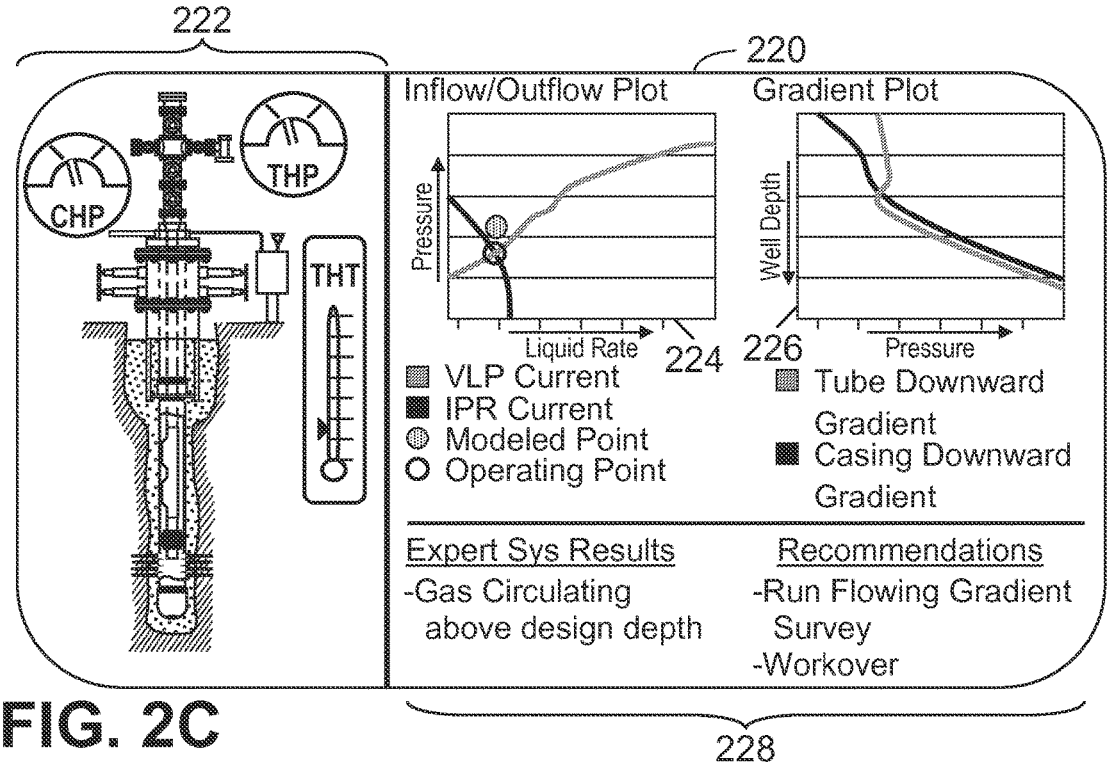
FIG. 2C
FIG. 2D
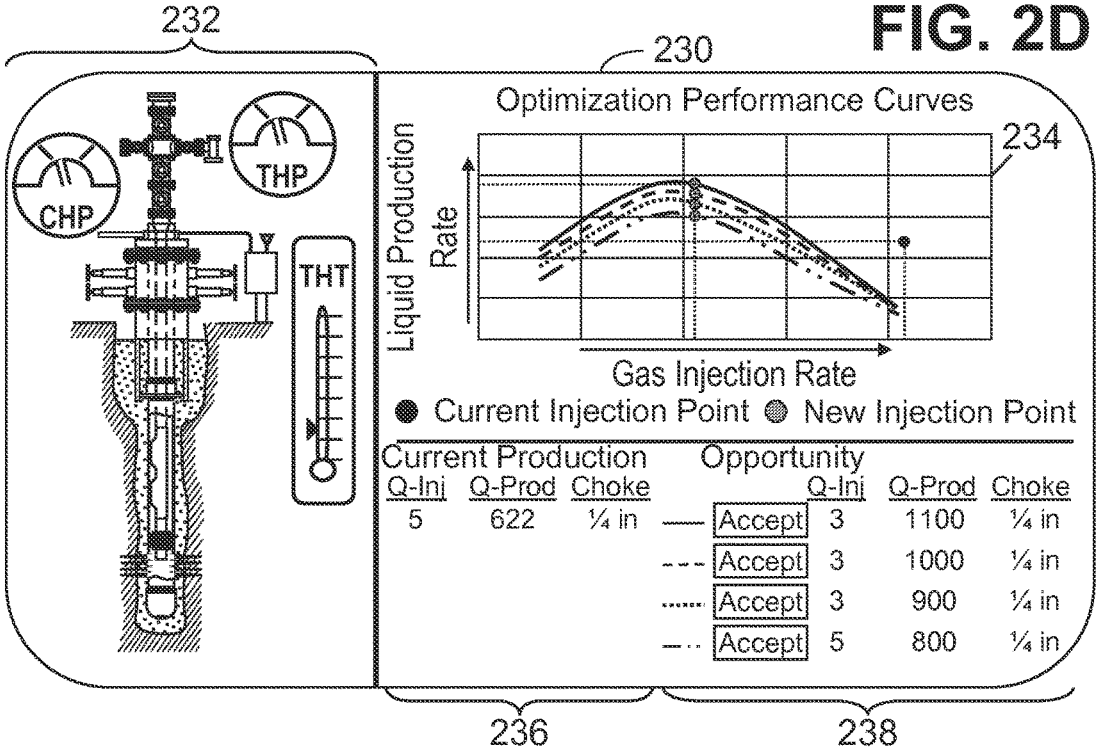

MONITORING, DIAGNOSING AND OPTIMIZING GAS LIFT OPERATIONS BY PRESENTING ONE OR MORE ACTIONS RECOMMENDED TO ACHIEVE A GL SYSTEM PERFORMANCE

CROSS-REFERENCE TO RELATED APPLICATIONS

This application claims priority to Provisional U.S. Application Ser. No. 61/678,069, titled "Monitoring, Diagnosing and Optimizing Gas Lift Operations" and filed Jul. 31, 2012 by M. M. Querales, M. Villamizar, G. Carvajal, R. K. Vellanki, G. Moricca, A. S. Cullick and J. Rodriguez, which is incorporated herein by reference.

BACKGROUND

Oil field operators dedicate significant resources to improve the recovery of hydrocarbons from reservoirs while reducing recovery costs. To achieve these goals, production engineers both monitor the current state of the reservoir and attempt to predict future behavior given a set of current and/or postulated conditions. The monitoring of wells by production engineers, sometimes referred to as well surveillance, involves the regular collection and monitoring of measured near-wellbore production data from within and around the wells. Such data may be collected using sensors embedded behind the well casing and/or from measurement devices introduced into the well with the production tubing. The data may include, but is not limited to, water and oil cuts, fluid pressure and fluid flow rates, and is generally collected at a fixed, regular interval (e.g., once per minute) and monitored in real-time by field personnel. As the data is collected, it is generally archived into a database.

In addition to monitoring conditions within the well, the systems used to lift produced fluids to the surface are also monitored. Such monitoring ensures that the systems are functioning as close to their optimal operating point as possible or practical, and that failures are detected and resolved promptly. One such type of system used is a gas lift (GL) system. Mandrels of the GL system are generally mounted along the production tubing and lowered into the well's production casing together with the tubing. Gas is introduced into the annular region between the casing and the tubing under pressure, and valves positioned along and/or within the mandrel allow the gas to be introduced into the fluid flow within the production tubing. GL systems help lift the product to the surface by reducing the density of the fluid (and thus the downhole pressure), which accelerates the movement of fluids from the formation through the perforations in the casing and up the production tubing.

Downhole sensors, if installed, collect and transmit data to the surface (e.g., via cables to the surface and/or wirelessly). The data may include, but is not limited to, injected gas lift pressure and temperature, and produced fluid pressure and temperature. Although the data provided enables monitoring of the performance of a GL system, determining the underlying cause of a failure or a variation in the performance of GL system is a more complicated task. A given GL system failure or performance variation can have numerous causes and operators strive to identify the cause of such issues quickly to reduce any resulting downtime or reduced production. While experienced petroleum/well surveillance personnel may rely on their personal experience to diagnose and resolve such issues, a more automated approach based on a broader information base offers the possibility of diagnosing issues and providing more optimal solutions in a shorter period of time.

BRIEF DESCRIPTION OF THE DRAWINGS

A better understanding of the various disclosed embodiments can be obtained when the following detailed description is considered in conjunction with the attached drawings, in which:

FIGS. 2A-2D show illustrative user interface displays for monitoring, diagnosing and optimizing GL operations.

It should be understood that the drawings and corresponding detailed description do not limit the disclosure, but on the contrary, they provide the foundation for understanding all modifications, equivalents, and alternatives falling within the scope of the appended claims.

DETAILED DESCRIPTION

The paragraphs that follow describe various illustrative systems and methods for monitoring, diagnosing and optimizing gas lift (GL) system operations. An illustrative production well and related data collection and processing system suitable for collecting and processing measured well and GL system data are first described. A description of a series of user interface displays follows, wherein the displays present data to a user as part of the disclosed GL system monitoring, diagnosing and optimizing. These displays are generated by a data acquisition and processing system that performs software-implemented versions of the disclosed methods. An illustrative GL system monitoring, diagnosing and optimizing method is described concurrently with the data acquisition and processing system. Finally, a GL system task ticketing method is described that supplements the disclosed GL system monitoring, diagnosing and optimizing.

Figure 1A:
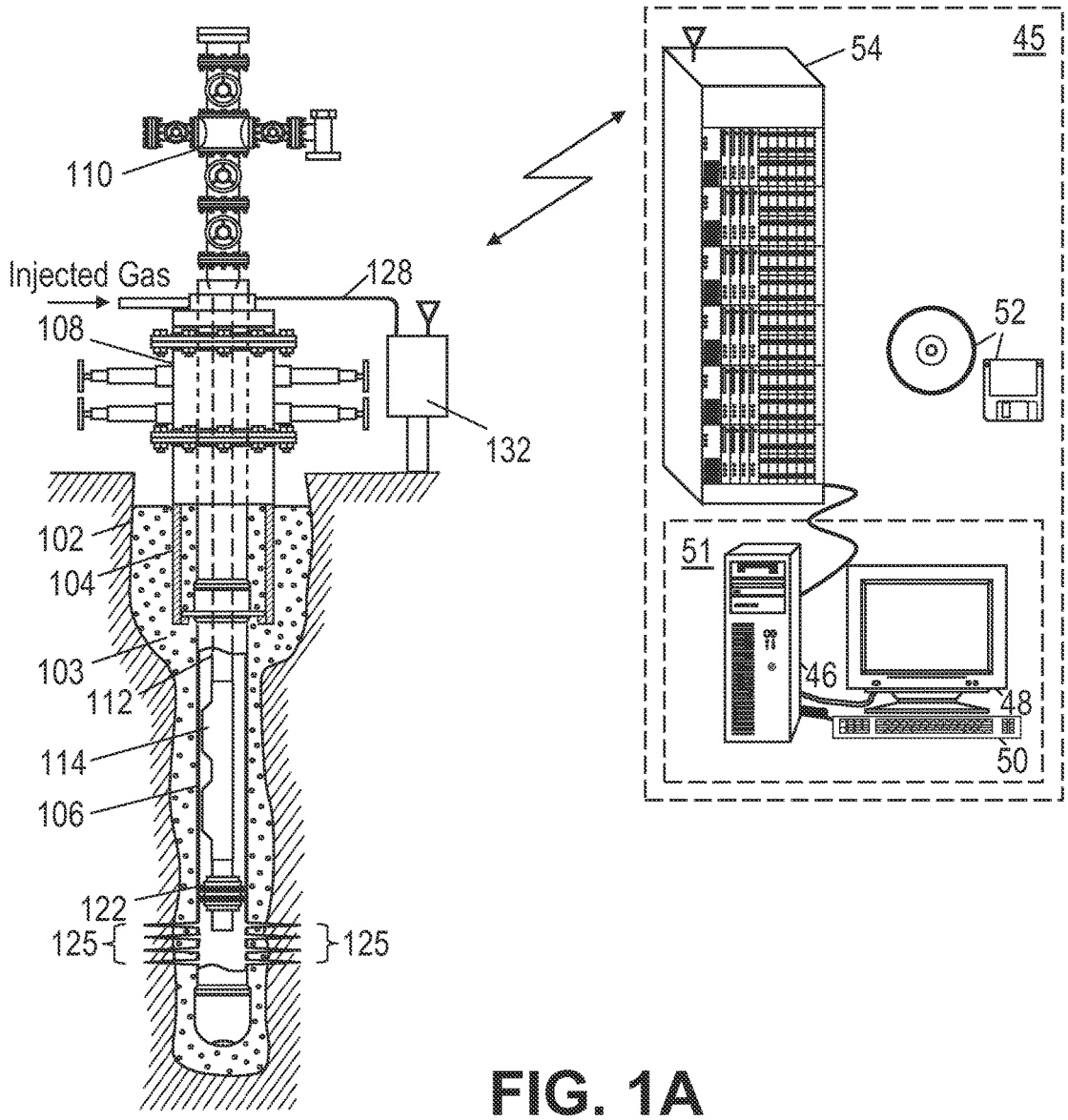
FIG. 1A shows a production well that sources measured well and gas lift (GL) system data.

The systems and methods described herein operate on measured data collected from wells, such as those found in oil and gas production fields. Such fields generally include multiple producer wells that provide access to the reservoir fluids underground. Measured well data is collected regularly from each producer well to track changing conditions in the reservoir. FIG. 1A shows an example of such data collection from a producer well with a borehole 102 that has been drilled into the earth. Such boreholes are routinely drilled to ten thousand feet or more in depth and can be steered horizontally for perhaps twice that distance. The producer well also includes a casing header 104 and casing 106, both secured into place by cement 103. Blowout preventer (BOP) 108 couples to casing header 106 and production wellhead 110, which together seal in the well head and enable fluids to be extracted from the well in a safe and controlled manner.

The use of measurement devices permanently installed in the well along with the GL system facilitates monitoring and control of said GL system. The different transducers send signals to the surface that may be stored, evaluated and used to control the GL system's operations. Measured well data is periodically sampled and collected from the producer well and combined with measurements from other wells within a reservoir, enabling the overall state of the reservoir to be monitored and assessed. These measurements, which may include bottom hole temperatures, pressures and flow rates, may be taken using a number of different downhole and surface instruments. Additional devices coupled in-line with production tubing 112 include GL mandrel 114 (controlling the injected gas flow into production tubing 112) and packer 122 (isolating the production zone below the packer from the rest of the well). Additional surface measurement devices may be used to measure, for example, the tubing head pressure and temperature and the casing head pressure.

Figure 1B:
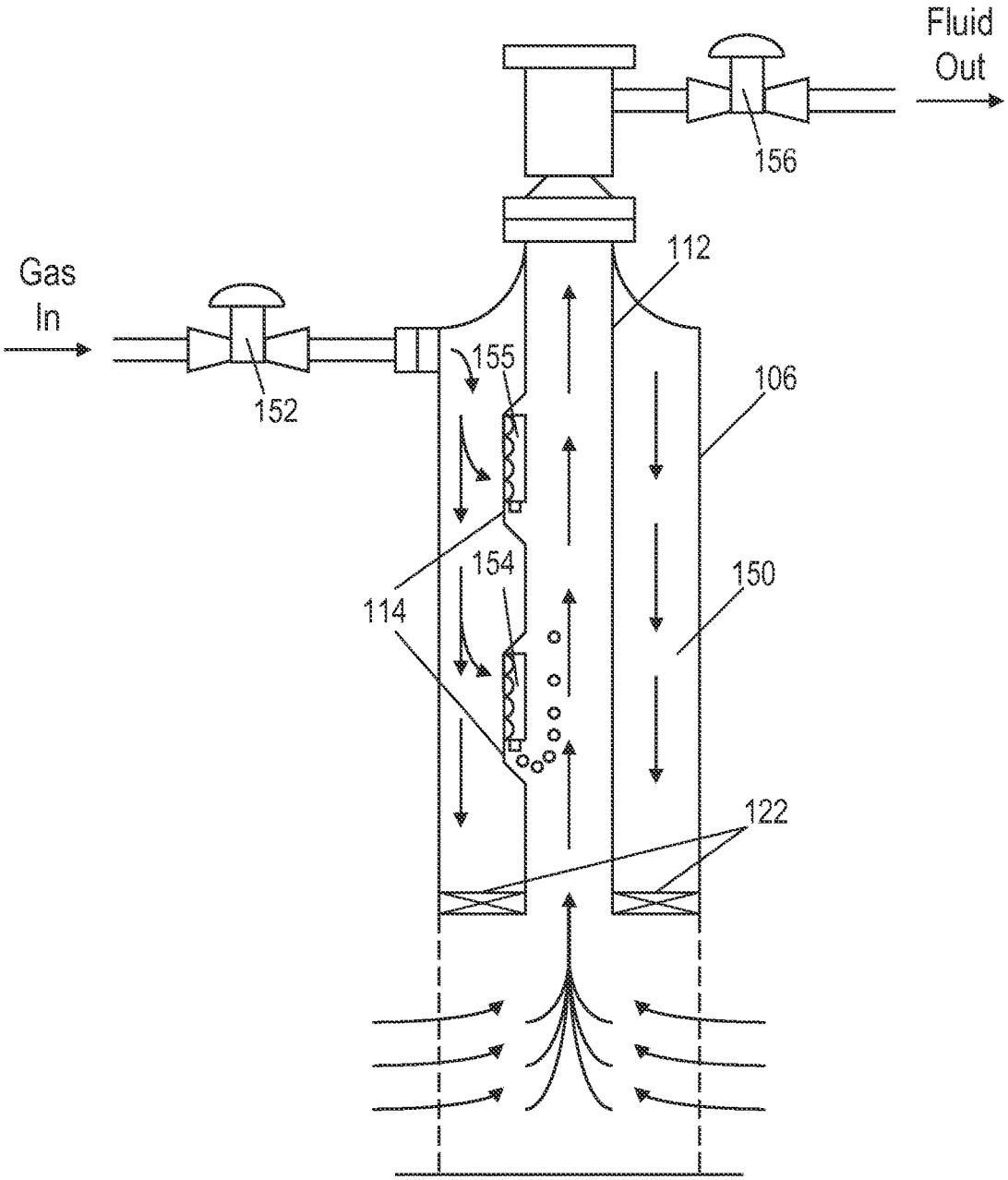
FIG. 1B shows a simplified diagram of an illustrative GL system.

FIG. 1B shows a diagram of the illustrative GL system incorporated into the producer well of FIG. 1A, and includes some components not shown in FIG. 1A while excluding others for clarity. Gas is injected into the annulus 150 between casing 106 and production tubing 112 via gas lift choke 152, which regulates the gas injection pressure. The pressurized gas within annulus 150, which is separated from the production zone by packer 122, passes through injection valve 154 (mounted on mandrel 114). In at least some illustrative embodiments additional values such as valve 155 are provided to increase the gas flow during the process of unloading the well (i.e., when initiating flow within a well by removing the column of kill fluid). FIG. 1B shows the well after unloading has completed and additional valve 155 has closed. The valves allow pressurized injection gas into production tubing 112 while preventing the fluid within the tubing from flowing back out into annulus 150, Fluid that includes formation oil and injected gas flow through injection tubing 112 to the surface and out production choke 156, which regulates the flow of produced fluid exiting the well.

Referring again to FIG. 1A, cable 128 provides power to various surface and downhole devices to which it couples (e.g., gas and/or fluid pressure, flow and temperature monitoring devices), as well as signal paths (electrical, optical, etc.), for control signals from control panel 132 to the devices, and for telemetry signals received by control panel 132 from the devices. Alternatively, the devices may be powered by other sources (e.g., batteries) with control and telemetry signals being exchanged between control panel 132 and the devices wirelessly (e.g., using acoustic or radio frequency communications) or using a combination of wired and wireless communication. The devices may be controlled and monitored locally by field personnel using a user interface built into control panel 132, or may be controlled and monitored by a computer system 45. Communication between control panel 132 and computer system 45 may be via a wireless network (e.g., a cellular network), via a cabled network (e.g., a cabled connection to the Internet), or a combination of wireless and cabled networks.

In at least some illustrative embodiments, data is collected using a production logging tool, which may be lowered by cable into production tubing 112. In other illustrative embodiments, production tubing 112 is first removed, and the production logging tool is then lowered into casing 106. In either case, the tool is subsequently pulled back up while measurements are taken as a function of borehole position and azimuth angle. In other alternative embodiments, an alternative technique that is sometimes used is logging with coil tubing, in which production logging tool couples to the end of coil tubing pulled from a reel and pushed downhole by a tubing injector positioned at the top of production wellhead 110. As before, the tool may be pushed down either production tubing 112 or casing 106 after production tubing 112 has been removed. Regardless of the technique used to introduce and remove it, the production logging tool provides additional data that can be used to supplement data collected from the production tubing and casing measurement devices. The production logging tool data may be communicated to computer system 45 during the logging process, or alternatively may be downloaded from the production logging tool after the tool assembly is retrieved.

Continuing to refer to FIG. 1A, control panel 132 includes a remote terminal unit (RTU) which collects the data from the downhole measurement devices and forwards it to a supervisory control and data acquisition (SCADA) system that is part of computer system 45. In the illustrative embodiment shown, computer system 45 includes a set of blade servers 54 that includes several processor blades, at least some of which provide the above-described SCADA functionality. Other processor blades may be used to implement the disclosed GL system monitoring, diagnosing and optimizing. Computer system 45 also includes user workstation 51, which includes a general processing system 46. Both the processor blades of blade server 54 and general processing system 46 are preferably configured by software, shown in FIG. 1A in the form of removable, non-transitory (i.e., non-volatile) information storage media 52, to process collected well and GL system data. The software may also include downloadable software accessed through a network (e.g., via the Internet). General processing system 46 couples to a display device 48 and a user-input device 50 to enable a human operator to interact with the system software 52. Alternatively, display device 48 and user-input device 50 may couple to a processing blade within blade server 54 that operates as general processing system 46 of user workstation 51.

The software executing on the processing blades of blade server 54 and/or on user workstation 51 presents to the user a series of displays, shown as the illustrative displays of FIGS. 2A-2D, that enable the user to determine the state of the GL system and to interact with the software to take action based on the information presented. FIG. 2A shows a status display 200 for a reservoir (the "Houston" reservoir) with eight wells of the reservoir displayed (wells HO-001 through HO-008). The display includes an advisory section 202 that lists current advisories (sorted by severity) for wells within the reservoir displayed, a reservoir map 204 that displays the geographic location of the wells within the reservoir and provides a visual status of each well (e.g., inactive, in alarm, with opportunities and optimized), a summary 206 of the number of wells in each status condition, and current real-time values for a selected well (e.g., HO-006 in FIG. 2A).

When a user of the system is notified of an advisory (e.g., an alarm, issue or a performance improvement opportunity), the user can select the well identified by the advisory to display a summary 210 of the well's current status as shown in FIG. 2B. The display enables a user to view current measured values 212 such as, for example, casing head pressure (CHP), tubing head pressure (THP) and tubing head temperature (THT), as well as real-time production data 214 such as fluid flow rates, oil flow rates, water cuts and gas/liquid ratios (GLRs). The display also presents historical data 216 for a selected time period.

If after reviewing the data for the selected well a user decides that the issue raised by the advisory warrants further analysis, the user can open a diagnostic display such as illustrative display 220 shown in FIG. 2C. Display 220 includes current measured values 222, inflow/outflow plot 224, gradient plot 226 and analysis results 228. The display can be used by the user to review the results of a nodal-analysis-based well model and compare the results to the measured data. In at least some illustrative embodiments, the nodal analysis is applied wherein an analytic equation set represents and models the flow and pressure (well model output values) of multi-phase fluids within the borehole. Well model input values can include reservoir permeability, reservoir thickness, reservoir porosity, well tubing friction, and completion and perforation characteristics. In the nodal analysis of the illustrative embodiment described, the well and surrounding region is divided into a series of points or "nodes", each having an inflow section and an outflow section. The inflow section includes components upstream of the selected node, while the outflow section includes components downstream of the selected node. The analyzed producing system is modeled as a group of components that includes reservoir rock, completions (e.g., gravel pack, open/closed perforations and open hole), vertical flow strings, restrictions, flow lines and integrated gathering networks through which fluid flows in through the inflow section and out through the outflow section.

Mismatches between measured values and the well model's calculated values can be indicative of issues, including problems with the equipment and/or changes in downhole conditions. For example, inflow/outflow plot 224 of FIG. 2C shows a mismatch between the actual operating point (the intersection of the Inflow Performance Relationship curve and the Vertical Lift Performance curve) and the operating point calculated by the well model. Software executing within the system may automatically detect the mismatch or respond to a user command, and in response to such detection or command compare the measured conditions of the GL system against a database of known GL system states. In at least some illustrative embodiments, a rule-based expert system determines the most likely cause of the measured conditions and suggests recommended actions to resolve said conditions. Both the most likely cause and the recommended actions to resolve the issue are generated by the expert system and presented at the bottom of the display as analysis system results 228. The user can select one or more recommended actions to resolve the identified condition(s), causing the model to be updated to reflect both the condition(s) and the recommended action(s) selected. The recommended action(s) may subsequently be implemented manually by field personnel (e.g., in response to a task ticket issued using the ticketing system described below). Alternatively, in at least some illustrative embodiments the recommended action(s) may be implemented automatically via commands issued by the SCADA system in response to the user's selection that change the GL system settings in the field (e.g., commanding a new choke setting).

Once a condition has been diagnosed and corrected, the disclosed methods and system may also be used to improve the performance of a system. In at least some illustrative embodiments, the user causes illustrative display 230 of FIG. 2D to be presented, which shows current measured values 232 of the well and GL system, current production measurements and control settings 236 and performance graph 234 generated by the updated well model. Performance graph 234 shows both the current performance point of the well/GL system as well as estimated performance curves calculated by the model. The corresponding values and settings 236 for the current operating point are shown below the graph. When the user selects a desired operating point, target values and control settings 238 (e.g., gas injection flow and choke setting) corresponding to the selected operating point are also displayed below the graph. The control settings shown are those calculated by the model to achieve various target values for the selected operating point (e.g., target liquid production rates that result for a given gas injection rate at different choke settings).

Figure 3:
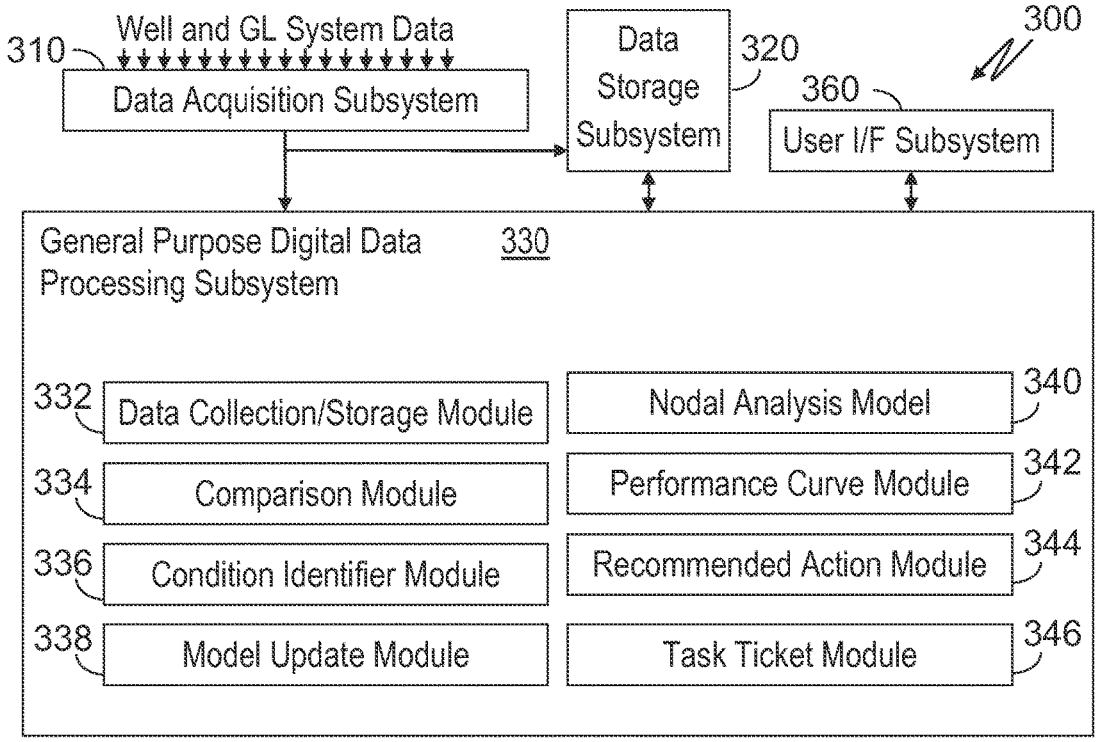
FIG. 3 shows an illustrative data acquisition and processing system suitable for implementing software-based embodiments of the systems and methods described herein.
Figure 4A:
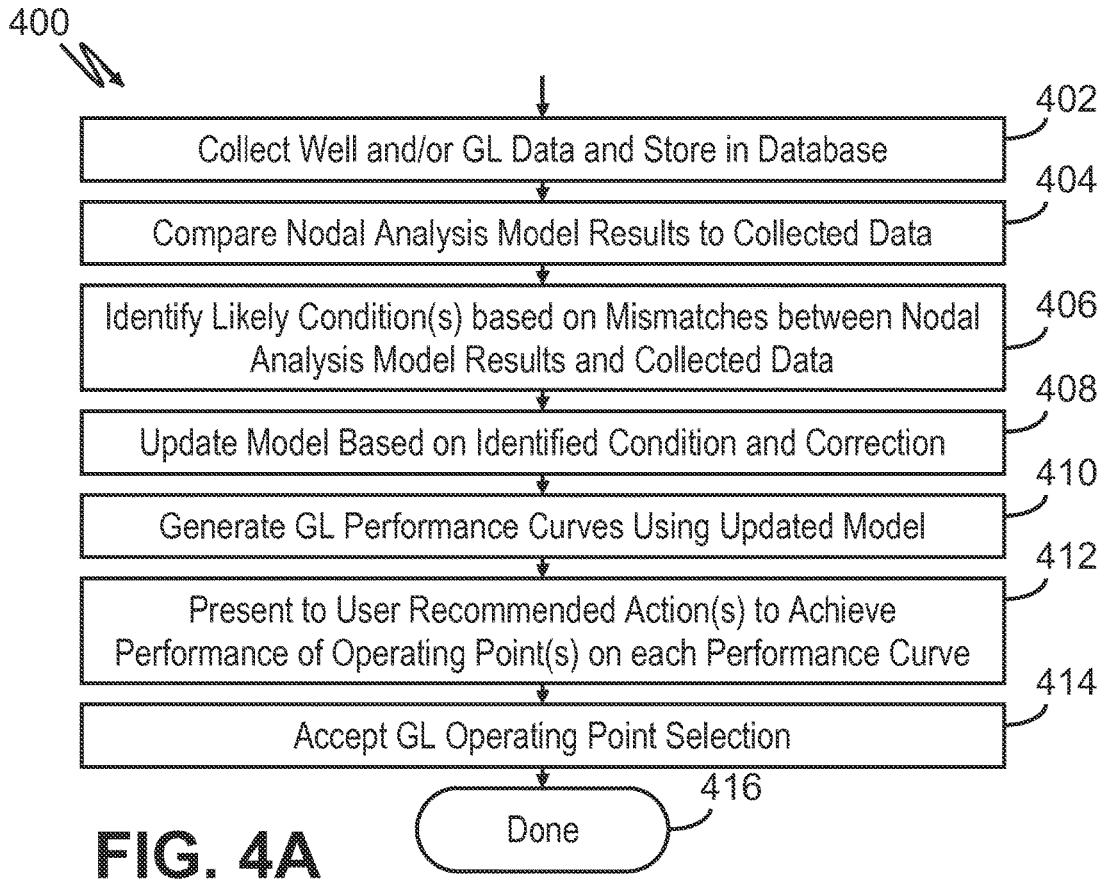
FIG. 4A shows an illustrative GL system monitoring, diagnosing and optimizing method.

A system that performs a software-implemented embodiment of the above-described method is shown in FIG. 3, and an illustrative embodiment of the method described is shown in FIG. 4A. Software modules are shown within the processing subsystem 330 of FIG. 3 that perform the functions described in the various blocks of FIG. 4A. More specifically, and referring to both FIGS. 3 and 4A, well and GL system data is collected via data acquisition subsystem 310 and stored by data collection/storage module 332 onto a database within data storage subsystem 320 (block 402). Data produced by well model 340 of the well is compared to the collected data by comparison module 334 (block 404). Data mismatches between the model results and the collected data are used by condition identifier module 336 to identify and present to the user the likely condition(s) causing mismatches (block 406). Model update module 338 updates well model 340 based on the identified condition and corresponding correction selected by the user (block 408), and performance curve update module 342 generates GL system performance curves based on data produced by the updated well model (block 410). Recommended action module 344 identifies and presents to the user a list of control values and/or other actions (e.g., a choke setting and a gas injection rate) calculated to produce a GL system performance consistent with a selected operating point (e.g., at or near the operating point within ± a determined tolerance value; block 412) from which the user selects a setting/action that is accepted by recommended action module 344 (block 414), ending method 400 (block 416). In at least some illustrative embodiments, recommended action module 344 also initiates a change to one or more GL system settings in response to accepting the user's selection (e.g., by issuing a task ticket to field personnel as described below, or by triggering a SCADA system command that automatically changes the relevant GL system settings).

Figure 4B:
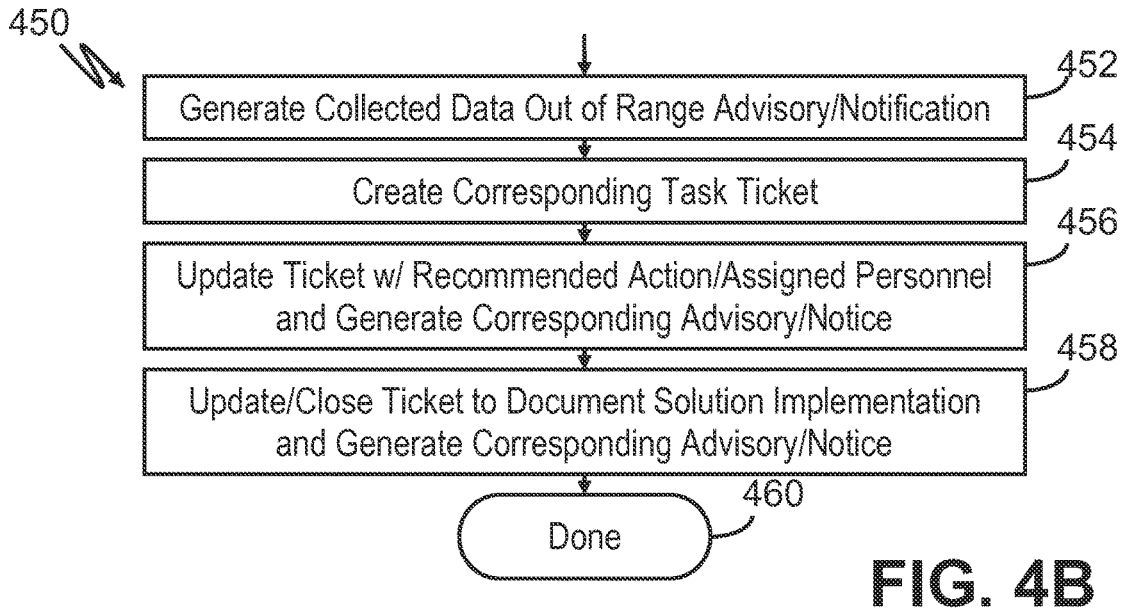
FIG. 4B shows an illustrative GL operations task ticketing method that works in conjunction with the illustrative GL system monitoring, diagnosing and optimizing method described.

The above-described systems and methods may be augmented by a task ticketing system (implemented, e.g., by task ticket module 346 of FIG. 3) that notifies field operator personnel of well conditions of interest as they occur, and that allows such conditions to be monitored and tracked as they progress form detection through diagnosis, correction and resolution. Within each phase, an authorization mechanism may be implemented requiring that supervisory personnel authorize field and/or engineering personnel before they are allowed to implement corrective action. FIG. 4B shows an illustrative method 450 that implements such a task ticketing system. When an advisory is generated by the monitoring, diagnosis and optimizing system during data collection (e.g., because a measured value has exceeded a threshold limit or is outside an allowable range of values), a notification is also generated (block 452) and a task ticket is created (block 454). The notification may include, for example, emails, automated text messages and/or pages, which are sent to contacts based on the nature of the underlying condition according to one or more previously configured distribution lists. As the process of diagnosing and correcting an alarm or issue and/or or improving the performance of a well/GL system progresses, the task ticket is updated to reflect any action taken. Such action may include assignment of personnel to address the underlying condition (block 456), any required authorizations, equipment corrections, repairs and/or replacements, and final resolution/disposition of the condition (block 458), ending the method (block 460). In at least some illustrative embodiments, additional notifications are generated each time the task ticket is updated. At least some of the task ticket updates may be performed automatically by the monitoring, diagnosing and optimizing system, while others may be manually performed by users of the system. Users may be given access to task tickets, whether only for viewing or for updating, according to an access permission structure similar to that used in a typical computer file system.

An embodiment of the present invention includes a method for monitoring, diagnosing and optimizing operation of a GL system that includes collecting measured data representative of a state of a GL system within a well, and further storing the measured data; comparing the measured data to calculated data generated by a model of the well; identifying one or more likely conditions of the GL system based at least in part on mismatches between the measured data and the calculated data; updating the well model to reflect the one or more likely conditions and one or more selected corrections to the one of the one or more likely conditions; generating a plurality of GL system performance curves using the updated well model; and presenting to a user one or more actions recommended to achieve a GL system performance consistent with a GL system operating point on at least one of the plurality of GL system performance curves.

The method can further include accepting a GL system operating point selection; and initiating a change to one or more GL system settings in response to the accepting of the selection.

The method can further include identifying the one or more likely conditions by comparing the measured data to a database of known GL system states.

The method can further include measured data that includes data selected from the group consisting of real-time data, recorded data and simulated data.

The method can further include data representative of the state of the GL system that includes data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate and one or more mandrel valve settings.

The method can further include generating an advisory message if a value of the measured data is detected outside of an allowable range of values and sending out a corresponding notification to one or more contacts of a distribution list; creating a task tracking ticket corresponding to the advisory message; updating the task tracking ticket to include the action recommended and personnel assigned to implement the solution; updating the task tracking ticket to document implementation of the solution and closing the task tracking ticket; and generating an additional advisory message and sending out an additional corresponding notification to the one or more contacts each time the task tracking ticket is updated.

The method can further include presenting to at least one of one or more users the current status of the task tracking ticket.

The method can further include determining if at least one of one or more users may view or update the task tracking ticket based upon an access permission structure.

Another embodiment of the present invention includes a GL monitoring, diagnosing and optimizing system that includes a memory having GL system monitoring, diagnosing and optimizing software, and one or more processors coupled to the memory. The software causes the one or more processors to collect measured data representative of a state of a GL system within a well, and further store the measured data; compare the measured data to calculated data generated by a model of the well; identify one or more likely conditions of the GL system based at least in part on mismatches between the measured data and the calculated data; update the well model to reflect the one or more likely conditions and one or more selected corrections to the one of the one or more likely conditions; generate a plurality of GL system performance curves using the updated well model; and present to a user one or more actions recommended to achieve a GL system performance consistent with a GL system operating point on at least one of the plurality of GL system performance curves.

The software included in the system can further cause the one or more processors to accept a GL system operating point selection, and initiate a change to one or more GL system settings in response to the acceptance of the selection.

The software included in the system can further implement a rule-based expert system that identifies the one or more likely conditions at least in part by comparing the measured data to a database of known GL system states.

The system can further include measured data that includes data selected from the group consisting of real-time data, recorded data and simulated data.

The system can further include data representative of the state of the GL system that includes data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate and one or more mandrel valve settings.

The software included in the system can further cause the one or more processors to generate an advisory message if a value of the measured data is detected outside of an allowable range of values and send out a corresponding notification to one or more contacts of a distribution list; create a task tracking ticket corresponding to the advisory message; update the task tracking ticket to include the action recommended and personnel assigned to implement the solution; update the task tracking ticket to document implementation of the solution and close the task tracking ticket; and generate an additional advisory message and send out an additional corresponding notification to the one or more contacts each time the task tracking ticket is updated.

Yet another embodiment of the present invention includes a non-transitory information storage medium having GL system monitoring, diagnosing and optimizing software that includes a data collection and storage module that collects measured data representative of a state of a GL system within a well, and further stores the measured data; a comparison module that compares the measured data to calculated data generated by a model of the well; a condition identifier module that identifies one or more likely conditions of the GL system based at least in part on mismatches between the measured data and the calculated data; a model update module that updates the well model to reflect the one or more likely conditions and one or more selected corrections to the one of the one or more likely conditions; a performance curve module that generates a plurality of GL system performance curves using the updated well model; and a recommended action module that presents to a user one or more actions recommended to achieve a GL system performance consistent with a GL system operating point on at least one of the plurality of GL system performance curves.

The recommended action module included on the storage medium can further accept a GL system operating point selection and initiate a change to one or more GL system settings in response to the selection.

The condition identifier module included on the storage medium can further include rule-based expert system software that identifies the one or more likely conditions at least in part by comparing the measured data to a database of known GL system states.

The measured data that is collected and stored by the software included on the storage medium can further include data selected from the group consisting of real-time data, recorded data and simulated data.

The data representative of the state of the GL system that is collected and stored by the software included on the storage medium can further include data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate and one or more mandrel valve settings.

The storage medium can further include a task ticket module that generates an advisory message if a value of the measured data is detected outside of an allowable range of values and sends out a corresponding notification to one or more contacts of a distribution list; creates a task tracking ticket corresponding to the advisory message; updates the task tracking ticket to include the action recommended and personnel assigned to implement the solution; updates the task tracking ticket to document implementation of the solution and closes the task tracking ticket; and generates an additional advisory message and sends out an additional corresponding notification to the one or more contacts each time the task tracking ticket is updated.

Numerous other modifications, equivalents, and alternatives, will become apparent to those skilled in the art once the above disclosure is fully appreciated. For example, although at least some software embodiments have been described as including modules performing specific functions, other embodiments may include software modules that combine the functions of the modules described herein. Also, it is anticipated that as computer system performance increases, it may be possible in the future to implement the above-described software-based embodiments using much smaller hardware, making it possible to perform the described monitoring, diagnosing and optimizing using on-site systems (e.g., systems operated within a well-logging truck located at the reservoir). Additionally, although at least some elements of the embodiments of the present disclosure are described within the context of monitoring real-time data, systems that use previously recorded data (e.g., "data playback" systems) and/or simulated data (e.g., training simulators) are also within the scope of the disclosure. It is intended that the following claims be interpreted to embrace all such modifications, equivalents, and alternatives where applicable.

What is claimed is:

1. A method performed by one or more processors for monitoring, diagnosing and optimizing operation of a gas lift (GL) system that comprises:

collecting measured data representative of a state of the GL system within a well, and further storing the measured data;

comparing the measured data to calculated data generated by a well model;

identifying, by the one or more processors, one or more likely conditions of the GL system based at least in part on mismatches between the measured data and the calculated data;

selecting, by a user, corrections to the one or more likely conditions causing the mismatches;

updating the well model to reflect the corrections to the one or more likely conditions;

generating a plurality of GL system performance curves using the updated well model;

selecting, by the user, a GL system operating point on at least one of the generated plurality of GL system performance curves using the updated well model;

generating, by the one or more processors, one or more actions recommended to achieve a GL system performance consistent with the user selected GL system operating point;

presenting to the user, via a display, the one or more actions recommended;

accepting a user selection of one of the displayed one or more actions recommended to achieve the GL system performance consistent with the user selected GL system operating point; and triggering a system command that automatically changes a setting of a GL choke of the GL system in response to the accepting of the user selection of the one of the displayed one or more actions recommended.

2. The method of claim 1, wherein identifying the one or more likely conditions comprises comparing the measured data to a database of known GL system states.

3. The method of claim 1, wherein the measured data comprises data selected from the group consisting of real-time data, recorded data or simulated data.

4. The method of claim 1, wherein measured the data representative of the state of the GL system comprises data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate or one or more mandrel valve settings.

5. The method of claim 1, further comprising:

generating an advisory message if a value of the measured data is detected outside of an allowable range of values and sending out a corresponding notification to one or more contacts of a distribution list;

creating a task tracking ticket corresponding to the advisory message;

updating the task tracking ticket to include an action recommended and personnel assigned to implement a solution;

updating the task tracking ticket to document implementation of the solution and closing the task tracking ticket; and generating an additional advisory message and sending out an additional corresponding notification to the one or more contacts each time the task tracking ticket is updated.

6. The method of claim 5, further comprising presenting to the one or more contacts the current status of the task tracking ticket.

7. The method of claim 5, further comprising determining if the one or more contacts may view or update the task tracking ticket based upon an access permission structure.

8. A gas lift (GL) monitoring, diagnosing and optimizing system that comprises:

a memory having GL system monitoring, diagnosing and optimizing software; and one or more processors coupled to the memory, the software causing the one or more processors to:

collect measured data representative of a state of a GL system within a well, and further store the measured data;

compare the measured data to calculated data generated by a well;

identify one or more likely conditions of the GL system based at least in part on mismatches between the measured data and the calculated data and presenting the identified one or more likely conditions causing the mismatches to a user;

update the well model to reflect the one or more likely conditions and to reflect one or more corrections, selected by the user, to the one of the one or more likely conditions;

generate a plurality of GL system performance curves using the updated well model;

generate one or more actions recommended to achieve a GL system performance consistent with a GL system operating point selected by the user on at least one of the generated plurality of GL system performance curves using the updated well model;

present to the user, via a display, the one or more actions recommended;

accept a user selection of one of the displayed one or more actions recommended to achieve the GL system performance consistent with the user selected GL system operating point; and trigger a system command that automatically changes a setting of a GL choke of the GL system in response to the accepting of the user selection of the one of the displayed one or more actions recommended.

9. The system of claim 8, wherein the software further implements a rule-based expert system that identifies the one or more likely conditions at least in part by comparing the measured data to a database of known GL system states.

10. The system of claim 8, wherein the measured data comprises data selected from the group consisting of real-time data, recorded data or simulated data.

11. The system of claim 8, wherein measured the data representative of the state of the GL system comprises data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate or one or more mandrel valve settings.

12. The system of claim 8, wherein the software further causing the one or more processors to:

generate an advisory message if a value of the measured data is detected outside of an allowable range of values and send out a corresponding notification to one or more contacts of a distribution list;

create a task tracking ticket corresponding to the advisory message;

update the task tracking ticket to include an action recommended and personnel assigned to implement a solution;

update the task tracking ticket to document implementation of the solution and close the task tracking ticket; and generate an additional advisory message and send out an additional corresponding notification to the one or more contacts each time the task tracking ticket is updated.

13. A non-transitory information storage medium having gas lift (GL) system monitoring, diagnosing and optimizing software that comprises:

a data collection and storage module that causes one or more processors to collect measured data representative of a state of a GL system within a well, and to further store the measured data;

a comparison module that causes the one or more processors to compare the measured data to calculated data generated by a well model;

a condition identifier module that causes the one or more processors to identify one or more likely conditions of the GL system based at least in part on mismatches between the measured data and the calculated data and present to a user the one or more likely conditions causing the mismatches;

a model update module that causes the one or more processors to update the well model to reflect the one or more likely conditions and to reflect one or more corrections, selected by the user, to the one of the one or more likely conditions;

a performance curve module that causes the one or more processors to generate a plurality of GL system performance curves using the updated well model; and a recommended action module that causes the one or more processors to present to a user, via a display, one or more actions recommended to achieve a GL system performance consistent with a GL system operating point selected by the user on at least one of the plurality of GL system performance curves, to accept a user selection of one of the displayed one or more actions recommended to achieve the GL system performance consistent with the user selected GL system operating point, and to trigger a system command that automatically changes a setting of a GL choke of the GL system in response to accepting of the user selection of the one of the displayed one or more actions recommended.

14. The storage medium of claim 13, wherein the condition identifier module comprises rule-based expert system software that identifies the one or more likely conditions at least in part by comparing the measured data to a database of known GL system states.

15. The storage medium of claim 13, wherein the measured data comprises data selected from the group consisting of real-time data, recorded data or simulated data.

16. The storage medium of claim 13, wherein measured the data representative of the state of the GL system comprises data selected from the group consisting of bottom hole pressure, bottom hole temperature, tube head pressure, tube head temperature, choke size, fluid flow rates, oil flow rates and water cuts, gas/liquid ratios, injected gas pressure, injected gas temperature, injected gas flow rate or one or more mandrel valve settings.

17. The storage medium of claim 13, wherein the software further comprises a task ticket module that:

generates an advisory message if a value of the measured data is detected outside of an allowable range of values and sends out a corresponding notification to one or more contacts of a distribution list;

creates a task tracking ticket corresponding to the advisory message;

updates the task tracking ticket to include an action recommended and personnel assigned to implement a solution;

updates the task tracking ticket to document implementation of the solution and closes the task tracking ticket; and generates an additional advisory message and sends out an additional corresponding notification to the one or more contacts each time the task tracking ticket is updated.

* * * * *